US008333384B2

(12) United States Patent
Simon

(10) Patent No.: US 8,333,384 B2
(45) Date of Patent: Dec. 18, 2012

(54) SELF-DEPLOYING GAME DEVICE

(75) Inventor: Yoann Simon, Lille (FR)

(73) Assignee: Decathlon, Villeneuve d'Ascq (FR)

( * ) Notice: Subject to any disclaimer, the term of this patent is extended or adjusted under 35 U.S.C. 154(b) by 0 days.

(21) Appl. No.: 12/158,737

(22) PCT Filed: May 6, 2008

(86) PCT No.: PCT/FR2008/050791

§ 371 (c)(1),
(2), (4) Date: Aug. 20, 2008

(87) PCT Pub. No.: WO2008/113961

PCT Pub. Date: Sep. 25, 2008

(65) Prior Publication Data

US 2009/0096171 A1 Apr. 16, 2009

(30) Foreign Application Priority Data

May 7, 2007 (FR) ..... 07 03287

(51) Int. Cl.
*A63B 63/00* (2006.01)

(52) U.S. Cl. ..... 273/400; 473/197; 473/478

(58) Field of Classification Search ..... 273/398–402; 473/476–478, 197

See application file for complete search history.

(56) References Cited

U.S. PATENT DOCUMENTS

| | | | | |
|---|---|---|---|---|
| 5,244,213 | A | 9/1993 | Armell | |
| 5,427,381 | A | 6/1995 | Macaluso et al. | |
| 5,989,130 | A | 11/1999 | Macaluso | |
| D441,040 | S * | 4/2001 | Cho | D21/705 |
| 6,264,573 | B1 * | 7/2001 | Zheng | 473/471 |
| 6,514,149 | B2 * | 2/2003 | Yoon | 473/197 |
| 6,517,444 | B1 * | 2/2003 | Yoon | 473/197 |
| 6,991,567 | B2 * | 1/2006 | Wong et al. | 473/478 |
| 7,021,630 | B1 * | 4/2006 | Cho | 273/401 |
| 7,198,274 | B2 * | 4/2007 | Cho | 273/400 |
| 2001/0034271 | A1 * | 10/2001 | Nozato | 473/197 |
| 2002/0030324 | A1 | 3/2002 | Macaluso | |
| 2003/0224866 | A1 * | 12/2003 | Chen | 473/197 |
| 2007/0235942 | A1 * | 10/2007 | Cho | 273/395 |
| 2009/0062026 | A1 * | 3/2009 | Cho | 473/194 |

FOREIGN PATENT DOCUMENTS

| | | | |
|---|---|---|---|
| EP | 0 766 582 | B1 | 8/2002 |
| WO | 02/074399 | A1 | 9/2002 |

OTHER PUBLICATIONS

International Search Report; PCT/FR2008/050791.

* cited by examiner

*Primary Examiner* — Mark Graham
(74) *Attorney, Agent, or Firm* — Ladas & Parry LLP

(57) ABSTRACT

A self-deploying game device, which is intended to receive an object. It includes a bowed structure with a basic loop that includes a front part in a horizontal plane and a rear part, and a goal loop, with a rear part in a horizontal plane, and a front part in a plane forming a non-zero angle with the horizontal plane. It also includes a flexible structure with a first part stretched inside the goal loop, and a second part stretched inside the rear part of the goal loop. In the deployed position, the front part of the basic loop rests on the ground, and the tension of the flexible structure is such that the basic loop, the goal loop, the flexible structure, and the ground, form a capture volume for the object, the entrance of which is bounded by the front part of the goal loop.

20 Claims, 3 Drawing Sheets

SELF-DEPLOYING GAME DEVICE

BACKGROUND OF THE INVENTION

Figure 1:
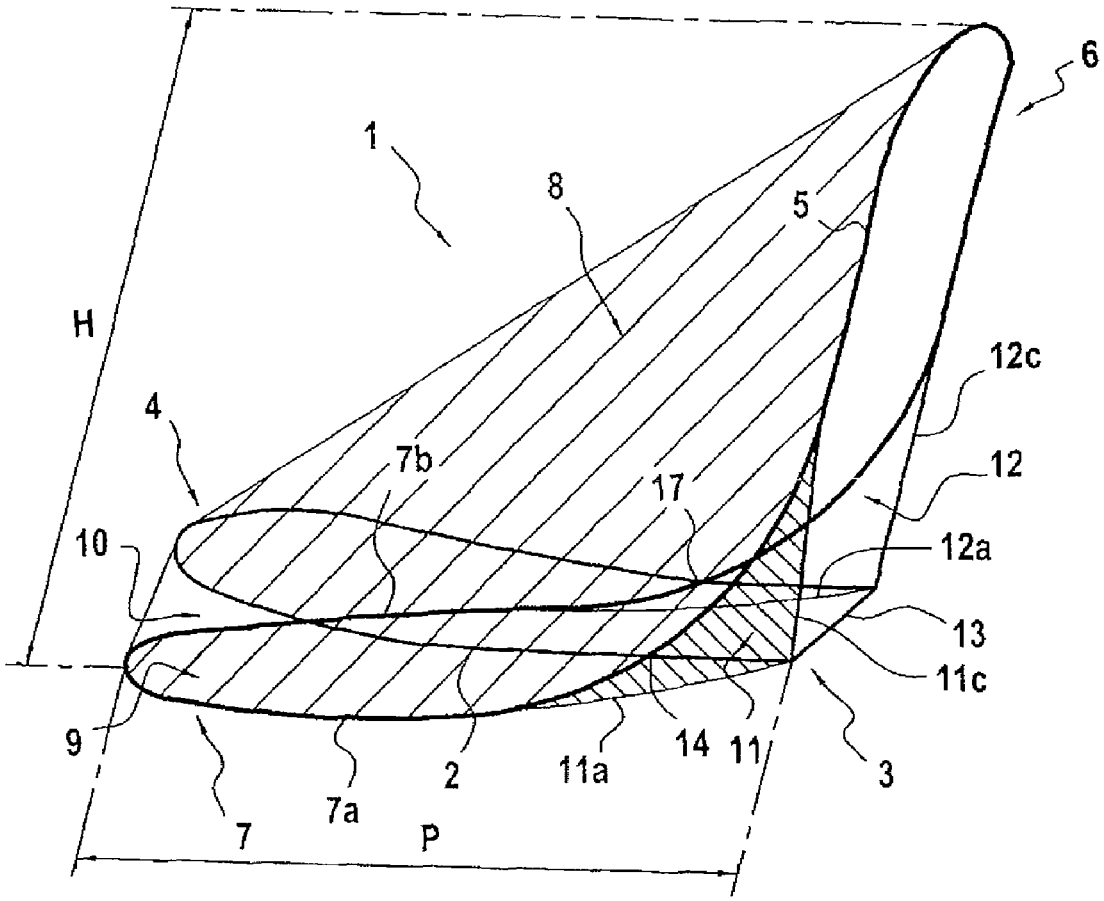

The subject of the present invention is a self-deploying game device that is intended to receive an object. This device is used particularly in ball games, in which the objective is to dispatch the ball into a goal, where, in a manner of speaking, this ball is captured in a given volume in the goal.

One is familiar with self-deploying ball-game devices that have the advantage of being easy to deploy and to fold, which are therefore employed in particular for the temporary installation of a ball-game playing area, and that, when folded, are easy to transport from place to place.

This is the case, for example, of the device described in document EP 0 766 582. This device has a bowed structure with a flexible element forming a substantially circular structure. This structure has two opposing elbows oriented in the same direction, forming an angle of about 90°.

A securing band is stretched between the two elbows in order to ensure the retention of the flexible element in the arched position, in which this flexible element forms a horizontal "U" and a vertical "U", that is intended to receive the ball. In addition, a net extends between this horizontal "U" and this vertical "U".

One of the problems created by this type of device is that it is not sufficiently stable, especially when a ball is dispatched at high speed into the goal.

We also know, from document WO 02/074399, a self-deploying device that is intended for golf practice, that includes two closed loops.

The first loop forms a horizontal contour, with a horizontal portion. The second loop is connected to two opposite sides of the first loop and has a first portion that is vertical and substantially perpendicular to the horizontal portion of the first loop. The other portion of the second loop is horizontal and is located close to the horizontal portion of the first loop.

A base panel is stretched inside the horizontal portion of the first loop, this horizontal portion of the first loop being located above the horizontal portion of the second loop.

Here again, although it is based on a two-loop structure, and therefore more stable than the device described in EP 0 766 582, such a device always tends to tilt backwards, particularly when a ball is dispatched at high speed into the vertical portion of the second loop.

However such a device does not provide a veritable ball capture volume to form a goal, as required for a game or a sport like the football for example.

In fact, in particular regarding the device described in WO 02/074399, the latter being intended for golf practice, it is necessary that the ball does not come into contact with the ground. Thus, this device has a flexible structure that is stretched inside the bowed structure.

In a first variant (see FIGS. 6 and 7 of this document for example), the flexible structure includes a first part that is stretched between the front (substantially vertical) part of the second loop and the rear part of the first loop. This rear part of the second loop is not horizontal and does not rest on the ground.

In another variant (see FIG. 11 of this document for example), the flexible structure includes a first part that is stretched between the front (substantially vertical) part of the second loop and the rear part of this same second loop. This rear part of the first loop is not horizontal and does not rest on the ground.

In addition, in each of these variants, the flexible structure has a second part that is stretched inside the sloping rear part, and giving a surface to receive the ball.

With such a flexible structure in which firstly a first part is always stretched between the front part of the second loop and a rear part of the first or non horizontal second loop, and secondly the other part is stretched backwards in a plane that is inclined in relation to the ground, the ball does not actually come into contact with the ground and exits naturally from the capture volume formed by the assembly, after entering it.

In this device, the capture volume is therefore formed by a cavity that does not come into contact with the ground, and that is intended to return the ball after it has entered it.

The stability of the structure then requires the use of side and rear straps, which are sufficient to the extent that the force with which a golf ball enters the capture volume is not very high.

This device is therefore complicated, especially due to the use of these additional straps which are intended to ensure the stability of the whole. In addition, it is not suitable for the practice of a sport such as football, in which the ball can enter the capture volume with great force, to the extent that it does not provide a veritable ball capture volume to form a goal that is stable.

The problem that then arises is therefore how to create a self-deploying ball-game device that is particularly suitable for games that require a veritable ball capture volume to form a goal, but that is also stable.

The purpose of the invention is therefore to provide a solution to the aforementioned and other problems.

The invention thus relates to a self-deploying game device, that is intended to receive an object, and a ball in particular.

The device has a bowed structure that includes a basic loop and a goal loop.

The basic loop has a front part in a substantially horizontal plane, and a rear part.

The goal loop has a rear part in a plane that is substantially horizontal, with two side parts, and a front part in a plane forming a non-zero angle with the horizontal plane.

Characteristically, the device also includes a flexible structure. This flexible structure includes at least one first part and a second part.

The first part of this flexible structure is stretched inside at least one part of the goal loop, between the front part of this goal loop and the rear part of this goal loop or of the basic loop.

The second part of the flexible structure is stretched inside at least one portion of the rear part of the goal loop, between the two side parts of this rear part of the goal loop.

In the deployed position, at least the front part of the basic loop rests on the ground, and the tension of the two parts of the flexible structure is such that the basic loop, the goal loop, the first part of the flexible structure, and the ground on which the device rests, form a volume (V) for capturing the object, in which the entry is bounded at least partially by the front part of the goal loop.

The fact that the capture volume (V) is formed partially by the ground and that the second part of the flexible structure is stretched in the rear part of the substantially horizontal goal loop, is used to create a veritable capture volume that is suitable for the practice of a sport such as football, in which the force with which the ball can enter the goal requires good stability and efficient capturing of the ball.

The game device is presented below in a certain number of variants, which can be used alone or in any combination.

The front part of the goal loop can be in a substantially vertical plane and directly above the front end of the basic loop.

The bowed structure can include a single crossed bow so as to form the basic loop and the goal loop.

The flexible structure can include a third part located between the respective rear parts of the basic and goal loops.

Preferably then, the third part of the flexible structure is equipped with a storage pocket to store any one or more objects.

This storage pocket can be attached by stitching onto the third part of the flexible structure. It can also be removable.

The first part of the flexible structure can be connected directly to the rear part of the basic loop.

The first part of the flexible structure can be connected directly to the rear part of the goal loop.

The goal loop can be closed, and the basic loop can form an open "U" at its front part.

Preferably then, the flexible structure includes fourth and fifth parts. These fourth and fifth parts are positioned respectively between firstly the front ends of the branches of the "U" forming the basic loop, and secondly the goal loop.

Again preferably, the fourth and/or the fifth part of the flexible structure have a form that is substantially triangular, with a horizontal side, a rear side, and a front side making a non-zero angle with the horizontal side. The front side is then equipped with a strengthening element, so as to partially stiffen the fourth and/or the fifth part.

This strengthening element is preferably flexible or foldable.

The fourth and/or the fifth part of the flexible structure are equipped with a storage pocket, to store any one or more objects.

The storage pocket or pockets are then preferably attached by stitching to the fourth and/or the fifth part of the flexible structure. They can also be removable.

The device can include a tape, of which the first end is connected to the end of the first branch of the "U" forming the basic loop, and the second end is connected to the end of the second branch of the "U" forming the basic loop, so as to mark a line that can be used as a shooting line.

At least one of the parts of the flexible structure is preferably composed of a textile net and/or textile tapes.

Again preferably, the basic loop and the goal loop fit together at two opposite intersection points, by a sliding action that allows these intersection points to be offset toward the front or the rear of the goal loop, so as to adjust the height (H) and/or the depth (P) of the volume (V) for capturing the object.

The device can include one or more elements for attachment to at least one of the parts of the flexible structure, close to the basic loop and/or of the goal loop.

These attachment elements are then elements of the "eyelet" type, which are intended to receive attachment elements of the "peg" type, preferably attached by stitching onto at least one of the parts of the flexible structure.

At its top end, the front part of the goal loop can have a handle.

This handle can be formed by a portion of the goal loop to which the first part of the flexible structure is not attached.

Thus, when it is deployed, the device of the invention is used in order to create a veritable ball capture volume forming a goal, such as that required for ball games like football for example.

The volume is created by the fitting together of the basic loop, the goal loop, and at least one part of the flexible structure.

This device can be folded with ease. It is also easy to transport in both deployed and folded position.

In addition, the fitting together of the basic loop and the goal loop, constrained by the tension of at least one part of the flexible structure, ensures good stability of the device, even when it is not fixed to the ground.

BRIEF DESCRIPTION OF THE DRAWING FIGURES

Other characteristics and advantages of the invention will appear more clearly and more completely on reading the description that follows of the preferred alternative embodiments of the device, which are given by way of non-limiting examples and with reference to the following appended drawings.

Figure 2:
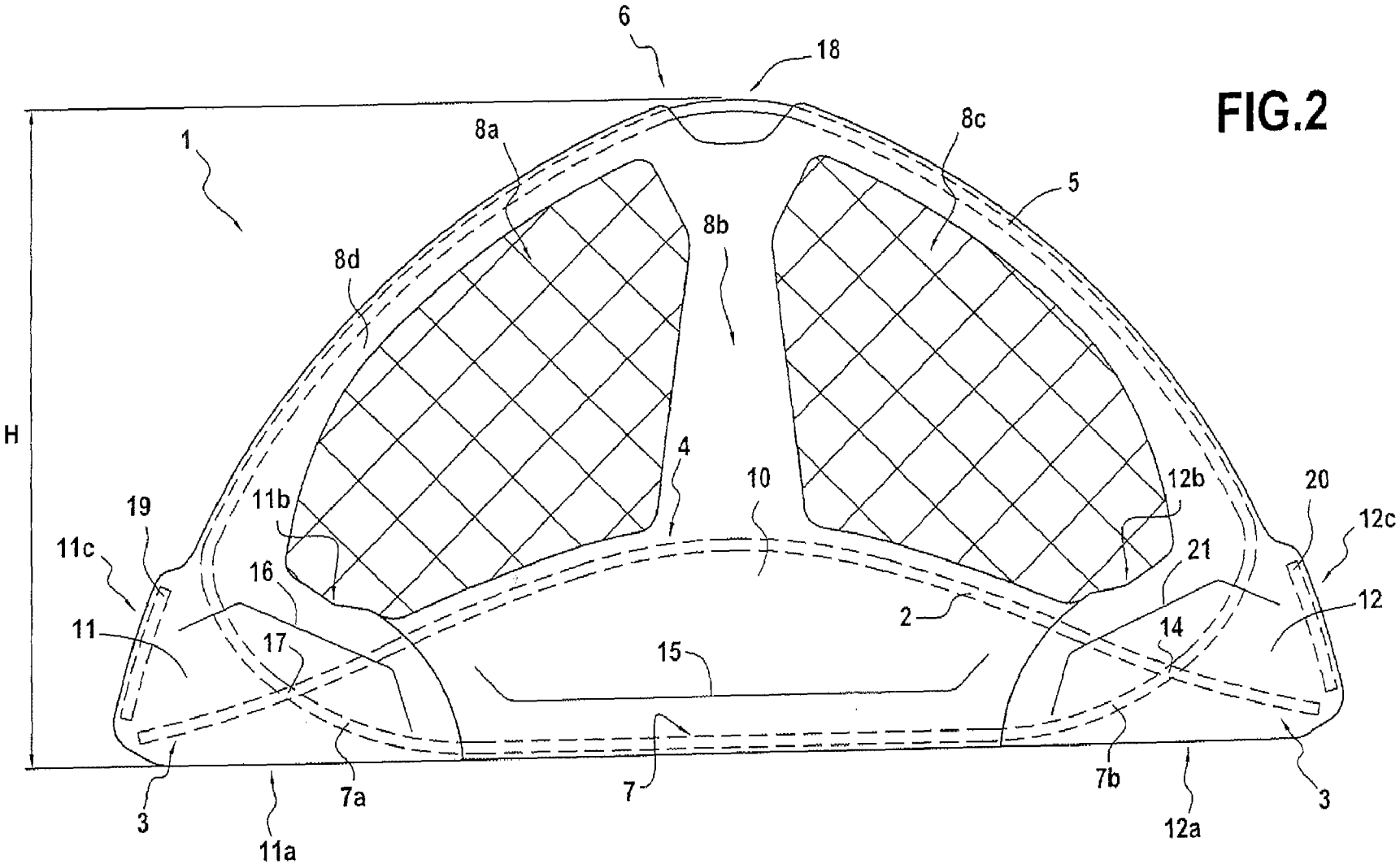
Figure 3A:
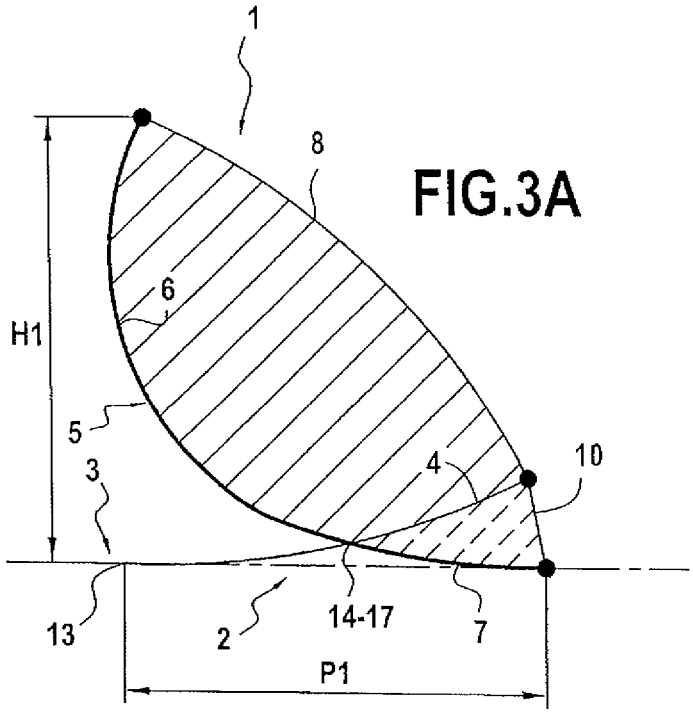
Figure 3B:
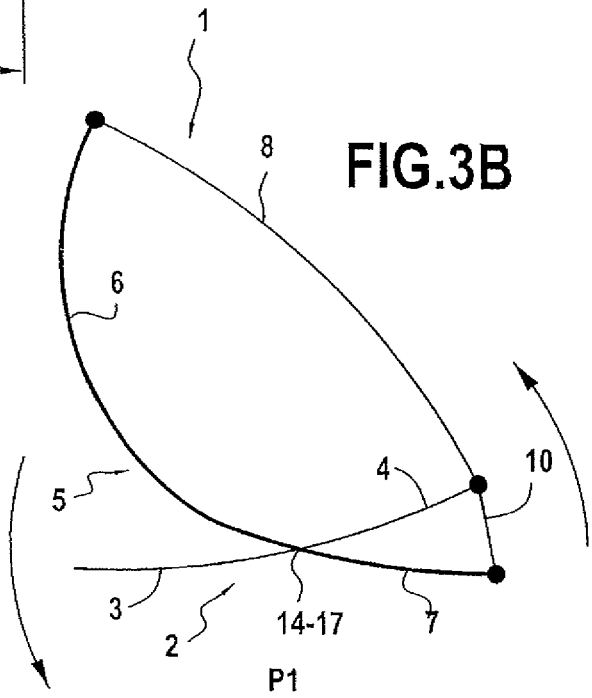
Figure 3C:
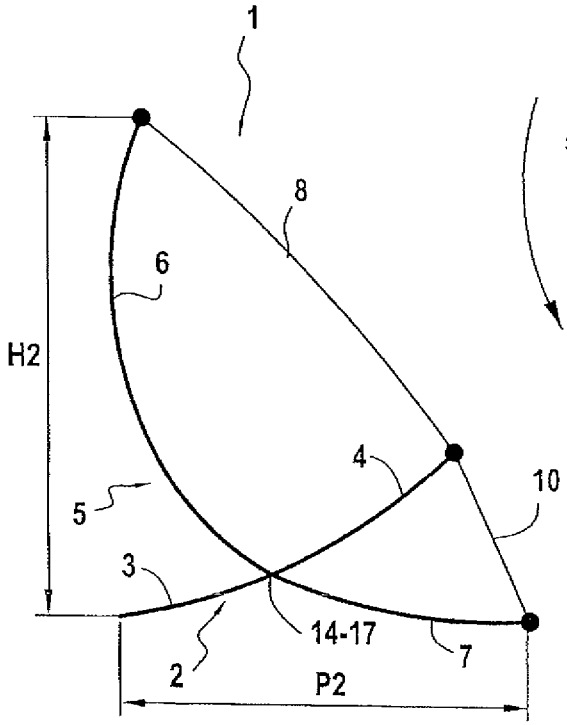

FIG. 1 schematically represents an example of the device of the invention in profile view, FIG. 2 schematically represents the example of FIG. 1 as seen from the front, with some details relating to the flexible structure, FIGS. 3*a* to 3*c* schematically represent the example of FIG. 1, in a first position, in an intermediate position, and in a second position respectively.

DETAILED DESCRIPTION OF THE PREFERRED EMBODIMENTS

We therefore find in FIG. 1 the self-deploying game device 1 of the invention, in the deployed position, with a bowed structure that includes a basic loop 2 and a goal loop 5.

In this exemplary embodiment, the goal loop 5 is a closed loop, and the basic loop has a "U-shape" that is open toward the front. This "U" could be open backwards however, instead of being open toward the front.

In addition, the goal loop could have a "U-shape" that is open either backwards or toward the front.

On could also envisage that the basic loop might be a closed loop.

The two basic 2 and goal 5 loops cross over each other at two intersection points, respectively 14 and 17.

The basic loop 2 has a front part 3 that is located in a substantially horizontal plane or ground plane, on which the device is intended to rest. This basic loop 2 also has a rear part 4.

By the front part 3 of the basic loop 2 is meant the part 3 of this basic loop 2 that is located in front of the intersection points 14 and 17 between the basic loop 2 and the goal loop 5.

In addition, by the rear part 4 of the basic loop 2 is meant the part 4 of this basic loop 2 that is located behind the intersection points 14 and 17 between the basic loop 2 and the goal loop 5.

The goal loop 5 has a rear part 7 in a substantially horizontal plane, or ground plane, on which the device is intended to rest.

This rear part 7 of the goal loop 5 has two side parts 7*a* and 7*b*.

The goal loop 5 also has a front part 6.

By the front part 6 of the goal loop 5 is meant the part 6 of this goal loop 5 that is located in front of the intersection points 14 and 17 between the basic loop 2 and the goal loop 5.

In addition, by the rear part 7 of the goal loop 5 is meant the part 7 of this goal loop 5 that is located behind the intersection points 14 and 17 between the basic loop 2 and the goal loop 5.

In the example represented in FIG. 1, this front part 6 of the goal loop 5 is in a substantially vertical plane, or perpendicular to the ground plane, and directly above the front end of the basic loop 2. In other words, the projection of the top end 6*a* of the goal loop 5 substantially coincides with the front end of the basic loop 2, shown in FIG. 1 by line 13.

More generally, the front part 6 of the goal loop 5 is in a plane forming a non-zero angle with the horizontal plane. The projection of the top end of the goal loop 5 to the ground is then either back from the front end of the basic loop 2, or in front of the latter.

The bowed structure can include a single crossed bow so as to form this basic loop 2 and this goal loop 5. However, it can also consist of two separate bows, as shown in FIG. 1.

Between the two basic 2 and goal 5 loops is stretched a flexible structure.

More precisely, inside the goal loop 5 is stretched a first part 8, which can be of the textile net type or textile tapes or a mixture of the two, as will be seen later in relation to FIG. 2.

This first part 8 of the flexible structure is stretched inside the front part 6 of the goal loop 5 and inside the rear part 4 of the basic loop 2. It is therefore connected directly to this rear part 4 of the basic loop 2.

Nevertheless, it is possible to envisage connecting this first part 8 of the flexible structure directly to the rear part 7 of the goal loop 5, the rear part 4 of the basic loop 2 then being free or connected to the rear part 7 of the goal loop 5 by another part 10 of the flexible structure, as will be shown later.

It will be seen that it is not necessary for the first part 8 of the flexible structure to be stretched inside the totality of the front part 6 of the goal loop 5, and even less so inside the totality of the goal loop 5.

In fact it suffices for this first part 8 of the flexible structure to be stretched between a portion of the front part 6 of the goal loop 5 and a portion of the rear part 7 of this goal loop 5, or of the rear part 4 of the basic loop 2.

In addition, this flexible structure includes a second part 9 that is stretched inside the rear part 7 of the goal loop 5, between the two side parts 7*a*, 7*b* of this rear part 7 of the goal loop 5.

It will also be seen that that it is not necessary for this second part 9 of the flexible structure to be stretched inside the totality of the rear part 7 of the goal loop 5.

In fact it suffices for this second part 9 of the flexible structure to be stretched inside a portion of the rear part 7 of the goal loop 5, between its two side parts 7*a*, 7*b*.

The bow or bows forming the basic 2 and goal 3 loops run preferably, and at least in part, in a duct that is not shown in FIG. 1.

This duct is partially represented in FIG. 2 but not referenced.

In this case, the flexible structure can be connected to the different parts concerned of the basic 2 and goal 5 loops, by stitching onto the aforementioned duct for example.

In the deployed position, as represented in FIG. 1, the device 1 has the form of a "shooting cage", particularly suitable for use in a ball game such as football.

In fact, the front part 3 of the basic loop 2 rests on the ground, and the tension of the two parts 8, 9 of the flexible structure is such that the basic loop 2, the goal loop 5, the first part 8 of the flexible structure, and the ground on which the device rests 1, form a ball capture volume V.

The entrance of this volume is bounded partially by the front part 6 of the goal loop 5.

The goal loop 5 thus determines the height and the depth of the goal.

The basic loop 2 provides stability and the self-supporting character of the device 1, and in particular prevents tilting of this device 1 toward the front.

The flexible structure places a constraint on the bowed structure, enabling the desired shape to be given to the device 1, and is used to stop the ball when the latter is projected into the goal.

As already mentioned above, the flexible structure can include a third part 10 located between the rear part 4 of the basic loop 2 and the rear part 7 of the goal loop 5.

Ideally, this third part extends from intersection point 14 to the opposite intersection point 17, passing via the end rear of the device 1.

The flexible structure also includes a fourth part 11 located between one of the front ends of the "U" forming the basic loop 2, and the goal loop 5.

Symmetrical to this fourth part 11, the flexible structure includes a fifth part 12 located between the other front end of the "U" forming the basic loop 2, and the goal loop 5.

As can be seen schematically in FIG. 1, these two parts 11 and 12 of the flexible structure have a substantially triangular overall shape, with respective horizontal sides 11*a*, 12*a*, respective rear sides 11*b*, 12*b* (not shown in FIG. 1 but represented in FIG. 2), and respective front sides 11*c*, 12*c*.

In order to stiffen each or at least some of these parts 11 and 12 of the flexible structure, it is possible to insert strengthening elements (references 19 and 20 in FIG. 2, but not shown in FIG. 1) along or close to the front side or sides 11*c* and/or 12*c*.

The tape 13, already mentioned earlier, is used to mark the shooting line. Its first end is connected to the end of any of the branches of the "U" forming the basic loop 2, and its second end is connected to the end of the other of these branches.

The basic loop 2 and the goal loop 5 fit together at the two opposite intersection points 14 and 17, so as to allow the movement of these intersection points 14 and 17.

Thus by moving the rear part 4 of the basic loop 2, the intersection point 14 and 17 also moves, resulting in an increase or reduction in the depth P and the height H of the device, and therefore of the capture volume V.

This is what is represented in the series of FIGS. 3*a* to 3*c*, which are schematic representations of the device 1 respectively in a first position, in an intermediate position during the movement of the intersection points 14 and 17, and in a second position after this movement.

In the first position, as represented in FIG. 3*a*, the device 1 has a height H1 and a depth P1.

This height H1 and this depth P1 are altered during the movement of the intersection points 14 and 17, especially by movement of the rear part 4 of the basic loop 2, as illustrated in FIG. 3*b*.

Finally, after a certain movement of these two intersection points 14 and 17, the device 2 has moved to the second position, represented in FIG. 3*c*.

In this second position, the device 1 has a height H2 that is greater than its height H1 in the first position, represented in FIG. 3*a*.

In addition, in this second position, the device 1 has a depth P2 that is less than its depth P1 in the first position, represented in FIG. 3*a*.

The result can be a variation of the capture volume V, since the reduction in depth does not necessarily make up for the increase in height, or vice versa, as a function of the movement of the intersection points 14 and 17.

FIG. 2 represents the device 1 presented above with reference to FIG. 1, but this time as seen from the rear, and with some additional details relating in particular to the flexible structure.

We therefore find the basic loop 2 in the "U-shape" that is open toward the front, with its front part 3 and its rear part 4.

We also find the (closed) goal loop 5 with its front part 6 and its rear part 7.

The first part 8 of the flexible structure stretched inside the goal loop, and connected directly to the rear part 4 of the basic loop 2, is broken down into a combination of textile matrices or nets 8*a*, 8*c*, and textile tapes 8*b* and 8*d*, the part 8*d* acting as a duct in which the goal loop 5 runs.

At the top of the goal loop 5 is formed a handle 18, at a position where duct 8*d* is interrupted, so that the bow does not run in this duct 8*d* and is therefore bare.

Alternatively, an opening can be created in the first part 8 of the flexible structure to form this handle, part 8*b* for example. In this case, the bow remains guided and protected by the duct 8*d*.

It is also possible to create an opening in the duct itself, i.e. the part 8*d* of the flexible structure, without total elimination of this duct at the position of the handle, to form this handle.

The second part 9 of the flexible structure, as presented earlier in relation to FIG. 1, is not represented in FIG. 2 for reasons of clarity. This is also the case of the tape 13 for marking the shooting line.

At the bottom of the goal, located between the rear part 4 of the basic loop 2 and the rear part 7 of the goal loop 5, we find the third part 10 of the flexible structure, extending from intersection point 14 to the opposite intersection point 17.

This third part 10 is equipped with a pocket 15 that is used to store objects, such as keys or a watch, during the game. This pocket 15 can be closed by a closure of the slide type for example.

This pocket 15 can be removable ("velcroed" for example), or can be attached by stitching onto the third part 10 of the flexible structure.

This pocket 15 preferably opens toward the exterior of the volume V of the goal, as represented in FIG. 2.

Alternatively, it could open toward the interior of the volume V of the goal.

In this FIG. 2 we also find the fourth 11 and fifth 12 parts of the flexible structure, of overall substantially triangular shape, positioned respectively between the front parts 3 of the branches of the "U" forming the basic loop, and the goal loop 5.

FIG. 2 shows the strengthening elements 19 and 20 inserted in, or attached to, the fourth 11 and the fifth 12 parts respectively of the flexible structure, along or close to their respective front sides 11*c* and 12*c*, in order to stiffen the latter. These strengthening elements are preferably foldable or flexible, in order that they do not constitute a hindrance during the folding of the device.

These fourth 11 and fifth 12 parts are equipped with pockets 16 and 21, which are used to store objects, such as keys or indeed a watch, during the game. These pockets 16 and 21 can be closed by fasteners of the slide type for example.

Like pocket 15, these pockets 16, 21 can be removable ("velcroed" for example), or again attached by stitching to the fourth and fifth parts 11, 12 respectively of the flexible structure.

These pockets 16, 21 also preferably open toward the exterior of the volume V of the goal, as is the case in FIG. 2.

Alternatively, these pockets could open toward the interior of the volume V of the goal.

Distributed along the base of the device 1 for example, in the flexible structure of the second part 9 (the third 10, fourth 11 and fifth 12 parts for example), one can also provide attachment elements such as eyelets, preferably attached by stitching, which are intended to receive attachment pegs (not shown in FIGS. 1 and 2).

The device 1 can be folded in a manner that is already known, for example by bringing the respective ends of the basic 2 and goal 5 loops toward each other, and then by applying one or more appropriate twisting forces to form turns or folds that can be stacked to give the whole the form of a general flat disk. The turns or folds can be constrained by a strap (to prevent accidental redeployment). This flat disk can then be placed in a holder for transportation and protection.

It is recalled that all of the foregoing description is given only by way of an example, and does not limit the invention.

In particular, the precise shapes of the different elements of the device are given here only as examples.

The invention claimed is:

1. A self-deploying game device, that is intended to receive an object, and a ball in particular, comprising:

a bowed structure that includes a basic loop with a front part in a substantially horizontal plane and a rear part, wherein the basic loop forms an open "U" at its front part, a closed goal loop with a rear part in a substantially horizontal plane with two side parts, and a front part in a plane forming a non-zero angle with the horizontal plane, and a flexible structure that includes at least:

(i) a first part stretched inside at least one part of the goal loop between the front part of this goal loop and the rear part of the basic or goal loop, (ii) a second part, distinct from the said first part, stretched inside at least one portion of the rear part of the goal loop, between the two side parts of this rear part of the goal loop wherein, in the deployed position, at least the front part of the basic loop rests on the ground, and the tension of the two parts of the flexible structure is such that a capture volume for capturing the object is formed, the bounds of which are formed by the basic loop, the goal loop, the first part of the flexible structure, and the ground on which the device rests, an entrance of which is bounded at least partially by the front part of the goal loop, wherein the front part of the goal loop is in a substantially vertical plane and directly above the front end of the basic loop, and wherein, in the folded position, the game device presents the form of a general flat disk.

2. The game device according to claim 1 wherein the bowed structure includes a single crossed bow so as to form the basic loop and the goal loop.

3. The game device according to claim 1, wherein the flexible structure includes a third part located between the respective rear parts of the basic and goal loops.

4. The game device according to claim 3, wherein the third part of the flexible structure is equipped with a storage pocket so as to store any one or more objects.

5. The game device according to claim 4, wherein the storage pocket is attached by stitching onto the third part of the flexible structure, or is removable.

6. The game device according to claim 1, wherein the first part of the flexible structure is connected directly to the rear part of the basic loop.

7. The game device according to claim 1, wherein the first part of the flexible structure is connected directly to the rear part of the goal loop.

8. The game device according to claim 1, wherein the flexible structure includes fourth and a fifth parts positioned respectively between firstly the front ends of the branches of the "U" forming the basic loop, and secondly the goal loop.

9. The game device according to claim 8, wherein the fourth and/or the fifth part of the flexible structure have a form that is substantially triangular, with a horizontal side, a rear side, and a front side making a non-zero angle with the horizontal side, and said front side is equipped with a strengthening element, preferably flexible or foldable, so as to partially stiffen said fourth and/or the said fifth part.

10. The game device according to claim 8, wherein the fourth and/or the fifth part of the flexible structure are equipped with a storage pocket in order to store any one or more objects.

11. The game device according to claim 10, wherein the storage pocket or pockets are attached by stitching onto the fourth and/or the fifth part of the flexible structure, or are removable.

12. The game device according to claim 1, further comprising a tape of which the first end is connected to the end of the first branch of the "U" forming the basic loop and the second end is connected to the end of the second branch of the said "U" forming the said basic loop, so as to mark a line that can be used as a shooting line.

13. The game device according to claim 1, wherein at least one of the parts of the flexible structure is composed of a textile net and/or textile tapes.

14. The game device according to claim 1, wherein the basic loop and the goal loop fit together at two opposite intersection points by a sliding action that allows offsetting of said intersection points toward the front or the rear of the goal loop, so as to adjust the height and/or the depth of the volume for capturing the object.

15. The game device according to claim 1, further comprising one or more elements for attachment to at least one of the parts of the flexible structure, close to the basic loop and/or the goal loop.

16. The game device according to claim 15, wherein the attachment elements are elements of the "eyelet" type which are intended to receive securing elements of the "peg" type, preferably attached by stitching onto at least one of the parts of the flexible structure.

17. The game device according to claim 1, wherein the front part of the goal loop has a handle at a top end.

18. A self-deploying football shooting cage for receiving a ball comprising:

a bowed structure that includes a basic loop with a front part in a substantially horizontal plane and a rear part;

a goal loop with a rear part in a substantially horizontal plane with two side parts, and a front part in a plane forming a non-zero angle with the horizontal plane, and a flexible structure that includes at least:

(i) a first part stretched inside at least one part of the goal loop between the front part of this goal loop and the rear part of the basic or goal loop, (ii) a second part, distinct from the said first part, stretched inside at least one portion of the rear part of the goal loop, between the two side parts of this rear part of the goal loop wherein, in the deployed position, at least the front part of the basic loop rests on the ground, and the tension of the two parts of the flexible structure is such that a capture volume for capturing the ball is formed, the bounds of which are formed by the basic loop, the goal loop, the first part of the flexible structure, and the ground on which the device rests, an entrance of which is bounded at least partially by the front part of the goal loop, wherein the front part of the goal loop is in a substantially vertical plane and directly about the front end of the basic loop, and wherein the goal loop is closed, and the basic loop forms an open "U" at its front part, and wherein the basic loop and the goal loop fit together at two opposite intersection points by a sliding action that allows offsetting of said intersection points toward the front or the rear of the goal loop, so as to adjust the height and/or the depth of the volume for capturing the ball.

19. The self-deploying football shooting cage according to claim 18, wherein in the folded position, the shooting cage presents the form of a general flat disk.

20. A self-deploying game device, that is intended to receive an object, and a ball in particular, comprising:

a bowed structure that includes a basic loop with a front part in a substantially horizontal plane and a rear part, a closed goal loop with a rear part in a substantially horizontal plane with two side parts, and a front part in a plane forming a non-zero angle with the horizontal plane, and a flexible structure that includes at least:

(i) a first part stretched inside at least one part of the goal loop between the front part of this goal loop and the rear part of the basic or goal loop, wherein the first part of the flexible structure is connected directly to the rear part of the basic loop, (ii) a second part, distinct from the said first part, stretched inside at least one portion of the rear part of the goal loop, between the two side parts of this rear part of the goal loop wherein, in the deployed position, at least the front part of the basic loop rests on the ground, and the tension of the two parts of the flexible structure is such that a capture volume for capturing the object is formed, the bounds of which are formed by the basic loop, the goal loop, the first part of the flexible structure, and the ground on which the device rests, an entrance of which is bounded at least partially by the front part of the goal loop, wherein the front part of the goal loop is in a substantially vertical plane and directly above the front end of the basic loop, and wherein, in the folded position, the game device presents the form of a general flat disk.

* * * * *